US008925916B2

(12) United States Patent
Honda et al.

(10) Patent No.: US 8,925,916 B2
(45) Date of Patent: Jan. 6, 2015

(54) SHEET DISCHARGING DEVICE AND IMAGE FORMING APPARATUS INCORPORATING SAME

(71) Applicants: Haruyuki Honda, Kanagawa (JP); Masanori Namba, Kanagawa (JP); Toshikane Nishii, Osaka (JP); Mitsutaka Nakamura, Hyogo (JP)

(72) Inventors: Haruyuki Honda, Kanagawa (JP); Masanori Namba, Kanagawa (JP); Toshikane Nishii, Osaka (JP); Mitsutaka Nakamura, Hyogo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/182,315

(22) Filed: Feb. 18, 2014

(65) Prior Publication Data

US 2014/0239578 A1 Aug. 28, 2014

(30) Foreign Application Priority Data

Feb. 28, 2013 (JP) ..... 2013-038913

(51) Int. Cl.

| | |
|---|---|
| ***B65H 43/00*** | (2006.01) |
| ***B65H 31/10*** | (2006.01) |
| ***B65H 43/06*** | (2006.01) |
| ***B65H 29/14*** | (2006.01) |

(52) U.S. Cl.

CPC ..... *B65H 31/10* (2013.01); *B65H 2511/152* (2013.01); *B65H 43/06* (2013.01); *B65H 2553/612* (2013.01); *B65H 29/14* (2013.01)

USPC ..... 271/176; 271/314

(58) Field of Classification Search

CPC .. B65H 29/14; B65H 43/06; B65H 2511/152; B65H 2553/612; B65H 2601/271

USPC ..... 271/176, 314, 207

See application file for complete search history.

(56) References Cited

U.S. PATENT DOCUMENTS

| | | | | |
|---|---|---|---|---|
| 5,033,731 | A * | 7/1991 | Looney | 271/176 |
| 7,407,160 | B2 * | 8/2008 | Peulen et al. | 271/207 |
| 7,677,557 | B2 * | 3/2010 | Ino | 271/220 |
| 8,152,163 | B2 * | 4/2012 | Kitan | 271/207 |
| 8,424,870 | B2 * | 4/2013 | Van Soest | 271/207 |
| 8,651,479 | B2 * | 2/2014 | Onishi | 271/220 |
| 2003/0062669 | A1 * | 4/2003 | Yamakawa et al. | 271/176 |
| 2006/0181019 | A1 * | 8/2006 | Peulen et al. | 271/314 |
| 2009/0295083 | A1 * | 12/2009 | Kitan | 271/306 |
| 2012/0112402 | A1 * | 5/2012 | Onishi | 271/109 |

FOREIGN PATENT DOCUMENTS

| | | |
|---|---|---|
| JP | 2003-128339 | 5/2003 |
| JP | 2003-137479 | 5/2003 |
| JP | 2010-275056 | 12/2010 |

* cited by examiner

*Primary Examiner* — David H Bollinger

(74) *Attorney, Agent, or Firm* — Harness, Dickey & Pierce, P.L.C.

(57) ABSTRACT

A sheet discharging device, which is included in an image forming apparatus, includes a sheet discharging tray, a sheet discharging roller pair, a full state detection feeler pivotably supported and including a center feeler to measure a height of a center part of the recording medium and an edge feeler to measure a height of an edge part of the recording medium, and a full state detection sensor to detect a position of the full state detection feeler. A distance between a leading edge of the center feeler and an upper surface of the sheet discharging tray is smaller than a distance between a leading edge of the edge feeler and the upper surface thereof. The leading edge of the edge feeler is located closer to the upper surface of the sheet discharging tray than a common tangential line of the sheet discharging roller pair.

10 Claims, 12 Drawing Sheets

SHEET DISCHARGING DEVICE AND IMAGE FORMING APPARATUS INCORPORATING SAME

CROSS-REFERENCE TO RELATED APPLICATIONS

This patent application is based on and claims priority pursuant to 35 U.S.C. §119 to Japanese Patent Application No. 2013-038913, filed on Feb. 28, 2013 in the Japan Patent Office, the entire disclosure of which is hereby incorporated by reference herein.

BACKGROUND

1. Technical Field

Embodiments of the present invention relate to a sheet discharging device to discharge a sheet having an image thereon on a sheet discharging tray, and an image forming apparatus incorporating the sheet discharging device.

2. Related Art

Known image forming apparatus generally include a sheet discharging unit. In the sheet discharging unit, a pair of sheet discharging rollers conveys a recording medium such as a paper sheet to be discharged onto a sheet discharging tray. The sheet discharging unit has a full state detection feeler and a full state detection sensor disposed downstream from the pair of sheet discharging rollers in a sheet conveying direction to detect a vertical paper loadable position of recording media discharged on the sheet discharging tray. Some techniques have been disclosed to change the paper loadable height of recording media in the full state according to a state of paper curl of the recording medium or media on the sheet discharging tray, so as to prevent the recording media on the sheet discharging tray from falling off the sheet discharging tray and/or disarrangement of the discharging order of the recording media.

Japanese Patent Application Publication No. JP 2003-137479-A discloses a configuration of a paper delivery device of an image forming apparatus. The paper delivery device includes a full state detecting filler to detect a full state of a sheet discharging tray. By connecting an auxiliary filler to a filler main body and selectively changing a connecting position, the full state detecting filler determines the full state according to a paper condition. However, the center area of a recording medium in a lateral direction is the only detection target of the full state detecting filler, this technique is not effective to a paper curl at both side edges while being effective to a paper curl at the leading edge and/or the trailing edge. Moreover, it is not realistic the setting of the full state detecting filler is changeable according to type and size of various recording media.

Japanese Patent Application Publication No. JP 2003-128339-A discloses an image forming apparatus having a configuration in which a first contact member and a second contact member are attached at the top of an arm of an actuator included in a full state detection feeler. This configuration can cause respective contact surfaces in the paper sheet discharging direction to contact from mutually different directions with the top surface of the paper sheet on a discharging tray. This configuration is designed so that the contact surface of the first contact member or the contact surface of the second contact member contacts the top of the paper sheet reliably even when a curled paper sheet is discharged on the discharging tray. This configuration is expected to prevent misdetection in which a full state is detected due to curled paper sheet even if a relatively small amount of paper sheets is discharged on the discharging tray, thereby improving accuracy in the full state detection of paper sheets. However, because of the same reasons as JP 2003-137479-A, the technique disclosed in JP 2003-128339-A is not effective to a recessed paper curl at both side edges. Further, since the technique of JP 2003-128339-A is employed to a movable discharging tray, when a compact image forming apparatus in which the height of a discharging tray is fixed uses this technique, the full state of paper sheets is detected before the amount of paper sheets reaching a target number of paper sheets with respect to the paper sheets having a small amount of curl.

Japanese Patent Application Publication No. JP 2010-275056-A discloses a configuration that provides a technique to employ an actuator including a full state detecting section and a rear-end curling detecting section, so as to detect a sheet paper full state and a paper curl state with a simple configuration. However, this technique is literally targeted to detect the rear-end curls, and therefore is not effective to the recessed paper curl at both side edges. Rather than that, a paper regulating sheet is disposed to contact a paper sheet to be discharged to a discharging tray so as to correct the curves at both side edges in the lateral direction of the paper sheet. However, it is likely that friction generated due to the contact of the paper sheet with the paper regulating sheet causes friction can cause a paper discharging problem. Therefore, another countermeasure is required to this inconvenience.

Consequently, it is clear that the above-described techniques cannot prevent paper stacking failures when the stack of paper sheets discharged on a discharging tray includes has a paper curl at both side edges. In addition, it is difficult to secure the target number of paper sheets that can be discharged on the discharging tray. It has become general that a height from a discharging port to a discharging stack surface is set as small as possible to reduce a distance between the discharging port and the discharging stack surface. However, it is likely that this configuration causes paper stacking failures in discharged paper sheets notably.

It is strongly demanded in these days that image forming apparatuses have a characteristic to be used in various installation environments. When an image forming apparatus is installed under high humidity conditions, paper sheets containing moisture can increase an amount or degree of paper curl after passing through a fixing unit in which heat and pressure are applied to the paper sheets. If the paper sheets are curled, specifically on at least either side thereof, the leading edge of a subsequent paper sheet hits the trailing edge of a curled proceeding sheet on the discharging tray to push the discharged paper sheet, which can cause paper stacking failure. In the image forming apparatus having a full state detecting mechanism at a downstream side from a pair of conveying rollers in a sheet conveying direction to detect a paper loadable height on a discharging tray, a printing operation is stopped before such sheet force-out occurs to prevent occurrence of paper stacking failure. However, if the full state detection mechanism is set to operate when a paper curl is detected, the full state is detected before reaching the target number of paper sheets even when the small amount of curled papers is discharged. This problem can be solved by increasing the capacity (the depth) of the discharging tray. However, due to a strong demand from the market to reduce the size of an image forming apparatus, it is not easy to achieve a solution to sufficiently solve both problems.

SUMMARY

At least one embodiment of the present invention provides a sheet discharging device including a sheet discharging tray to which a recording medium having an image formed thereon is discharged, a sheet discharging roller pair to discharge the recording medium conveyed by a sheet conveying member disposed upstream from the sheet discharging roller pair to the sheet discharging tray, a full state detection feeler pivotably supported to measure a height of a stack of recording media including the recording medium on the sheet discharging tray and including a center feeler to measure a height of a center part of a flat surface of the recording medium in a direction perpendicular to a sheet conveying direction and an edge feeler to measure a height of an edge part of the flat surface of the recording medium in the direction perpendicular to the sheet conveying direction, and a full state detection sensor to detect a position of the full state detection feeler. A distance between a leading edge of the center feeler and an upper surface of the sheet discharging tray is smaller than a distance between a leading edge of the edge feeler and the upper surface of the sheet discharging tray. The leading edge of the edge feeler is located closer to the upper surface of the sheet discharging tray than a common tangential line of the sheet discharging roller pair.

Further, at least one embodiment of the present invention provides an image forming apparatus including an image forming unit to form an image on a surface of an image carrier, and the above-described sheet discharging device.

BRIEF DESCRIPTION OF THE DRAWINGS

A more complete appreciation of the invention and many of the advantages thereof will be obtained as the same becomes better understood by reference to the following detailed description when considered in connection with the accompanying drawings, wherein.

DETAILED DESCRIPTION

Figure 1:
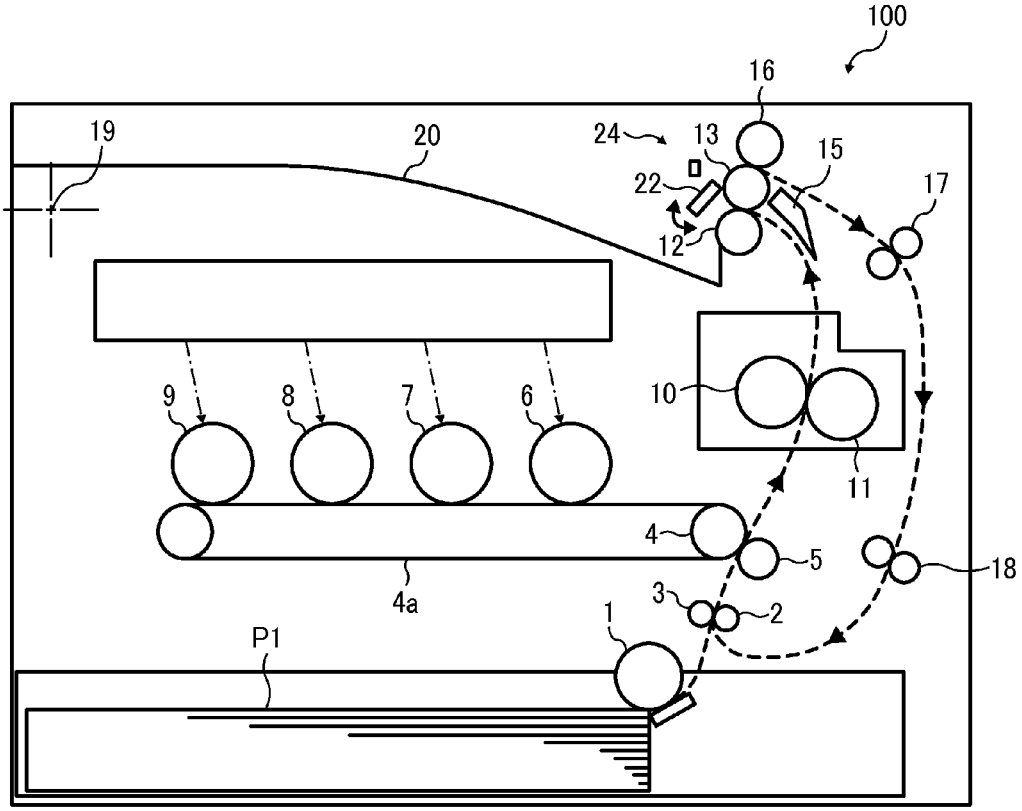
FIG. 1 is a schematic cross sectional view illustrating an entire configuration of an image forming apparatus according to an embodiment.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present invention.

The terminology used herein is for describing particular embodiments and is not intended to be limiting of exemplary embodiments of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to exemplary embodiments of the present invention. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of the present invention.

The present invention is applicable to any image forming apparatus, and is implemented in the most effective manner in an electrophotographic image forming apparatus.

In describing preferred embodiments illustrated in the drawings, specific terminology is employed for the sake of clarity. However, the disclosure of the present invention is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, preferred embodiments of the present invention are described.

A description is given of an entire configuration of an image forming apparatus 100 according to an embodiment with reference to FIG. 1.

The image forming apparatus 100 may be a copier, a facsimile machine, a printer, a multifunction peripheral or a multifunction printer (MFP) having at least one of copying, printing, scanning, facsimile, and plotter functions, or the like. According to the present embodiment, the image forming apparatus 100 is an electrophotographic color printer that forms color and monochrome toner images on recording media by electrophotography.

The image forming apparatus 100 includes a feed roller 1, registration rollers 2 and 3, transfer rollers 4 and 5, photoconductors 6, 7, 8, and 9, a heat body 10, a pressure body 11, a sheet discharging driven roller 12, a sheet discharging drive roller 13, a separation claw 15, a reverse driven roller 16, a pair of duplex rollers 17 and 18, a sheet discharging tray 20, a full state detection feeler 22, a full state detection sensor 23, and a sheet discharging device 24.

The feed roller 1 is disposed in a sheet feeding part located at a lower part of the image forming apparatus 100. The feed roller 1 picks up and feeds a recording medium P from a stack of new recording media P1. After the recording medium P has reached the registration rollers 2 and 3, the feed roller 1 continues the rotation to correct skew of the recording medium P at a nip area between the registration rollers 2 and 3. Thereafter, the feed roller 1 stops the rotation temporarily. The registration rollers 2 and 3 starts the rotation again to synchronize with movement of a toner image to arrive the transfer rollers 4 and 5.

Images formed based on image data in an image forming part are transmitted to the respective photoconductors 6, 7, 8, and 9 via respective laser light beams. The images are transferred onto an intermediate transfer belt 4a to form a composite toner image. By the time the composite toner image reaches the transfer rollers 4 and 5, the recording medium P is conveyed by the registration rollers 2 and 3 so that the composite toner image is transferred onto the recording medium P.

After application of heat by the heat body 10 and pressure by the pressure body 11, the recording medium P is conveyed to the sheet discharging driven roller 12 and the sheet discharging drive roller 13 to be discharged to the sheet discharging tray 20. The sheet discharging driven roller 12 and the sheet discharging drive roller 13 form a sheet discharging roller pair.

When both sides of the recording medium P are to be printed by performing a duplex printing, the separation claw 15 powered up by a solenoid rotates clockwise to change a sheet conveying direction of the leading edge of the recording medium P conveyed from the heat body 10 and the pressure body 11 to the sheet discharging drive roller 13 and the reverse driven roller 16. The sheet discharging drive roller 13 and the reverse driven roller 16 are a pair of rollers to reverse the recording medium before the recording medium P is discharged to the sheet discharging tray 20. The rotation direction of the sheet discharging drive roller 13 changes and reverses its rotation direction at the timing the trailing edge of the recording medium P has not yet passed through the sheet discharging drive roller 13 and the reverse driven roller 16. The reversed recording medium P is then conveyed to a duplex path where the pair of duplex rollers 17 and 18 are disposed. The recording medium P that has passed through a duplex path passes through the registration rollers 2 and 3 and a regular sheet conveying path to complete the duplex printing.

Here, a description is given of various examples of paper curl with reference to FIGS. 2A through 2H.

Figure 2A:
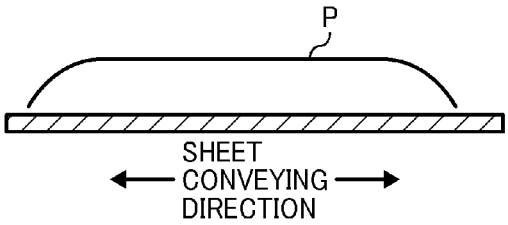
FIG. 2A is a schematic diagram illustrating a curled recording medium on a discharging tray, viewed from a width direction perpendicular to a sheet conveying direction.
Figure 2B:
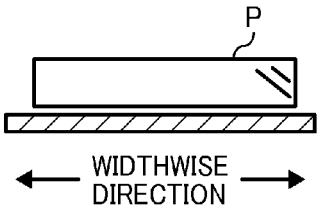
FIG. 2B is a schematic diagram illustrating the curled recording medium of FIG. 2A, viewed from the sheet conveying direction.
Figure 2C:
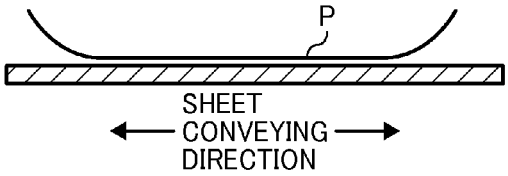
FIG. 2C is a schematic diagram illustrating another curled recording medium on a discharging tray, viewed from the width direction of the recording medium.
Figure 2D:
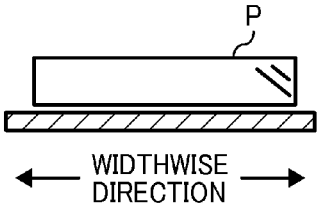
FIG. 2D is a schematic diagram illustrating the curled recording medium of FIG. 2C, viewed from the sheet conveying direction.

FIGS. 2A and 2B illustrate a state of a downward paper curl with both edges of a recording medium P in the sheet conveying direction lower than the center part of the recording medium P. FIGS. 2C and 2D illustrate a state of an upward paper curl with both edges of the recording medium P in the sheet conveying direction higher than the center part of the recording medium P. A paper curl at the leading edge of the recording medium P in the sheet conveying direction as illustrated in FIGS. 2A and 2C is referred to as a "face curl" and a paper curl at the trailing edge of the recording medium P in the sheet conveying direction as illustrated in FIGS. 2A and 2C is referred to as a "back curl".

Figure 2E:
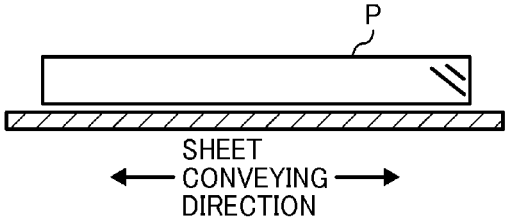
FIG. 2E is a schematic diagram illustrating yet another curled recording medium on a discharging tray, viewed from the width direction of the recording medium.
Figure 2F:
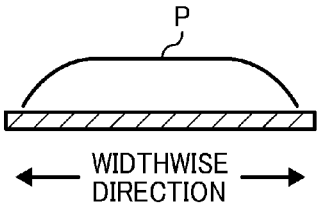
FIG. 2F is a schematic diagram illustrating the curled recording medium of FIG. 2E, viewed from the sheet conveying direction.
Figure 2G:
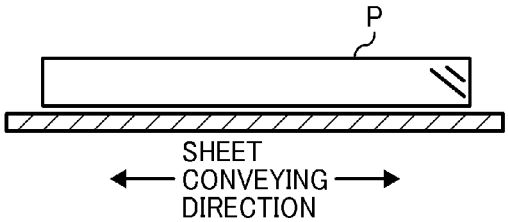
FIG. 2G is a schematic diagram illustrating yet another curled recording medium on a discharging tray, viewed from the width direction of the recording medium.
Figure 2H:
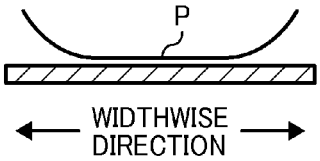
FIG. 2H is a schematic diagram illustrating the curled recording medium of FIG. 2G, viewed from the sheet conveying direction.

FIGS. 2E and 2F illustrate a state of a downward paper curl with both side edges of the recording medium P in a widthwise direction or a direction perpendicular to the sheet conveying direction lower than the center part of the recording medium P. FIGS. 2G and 2H illustrate a state of an upward paper curl with both edges of the recording medium P in the direction perpendicular to the sheet conveying direction higher than the center part of the recording medium P. A paper curl at both edges of the recording medium P in the direction perpendicular to the sheet conveying direction as illustrated in FIGS. 2F and 2H is referred to as a "side curl". Further, a paper curl with both side edges curling downward as illustrated in FIGS. 2A and 2F is occasionally referred to as a "projection curl" and a paper curl with both side edges curling upward as illustrated in FIGS. 2C and 2H is occasionally referred to as a "recessed curl".

There are various factors to cause paper curl. As described above with reference to FIGS. 2A through 2H, a side curl illustrated in FIG. 2H has a large amount of curl to which a measure to correct may need to be taken. Even though detailed mechanism of occurrence of paper curl is omitted here, the main factor is that an image on a printed side of the recording medium P contacts the heat body 10 and an image on a non-printed side of the recording medium P contacts the pressure body 11.

Figure 3A:
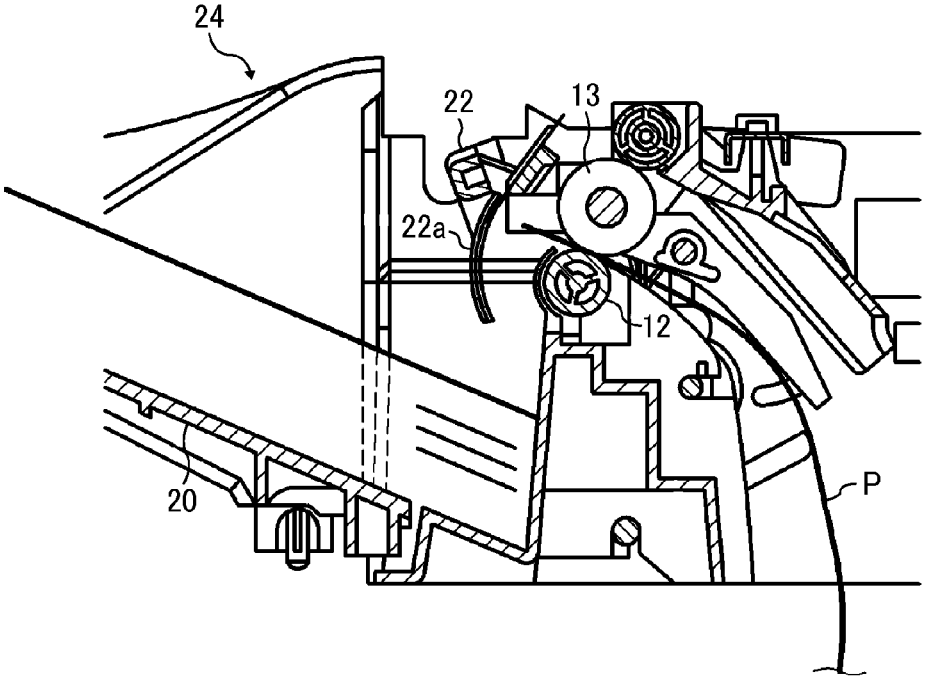
FIG. 3A is a cross sectional view illustrating a full state detection mechanism immediately before the leading edge of a recording medium hits a full state detection feeler.
Figure 3B:
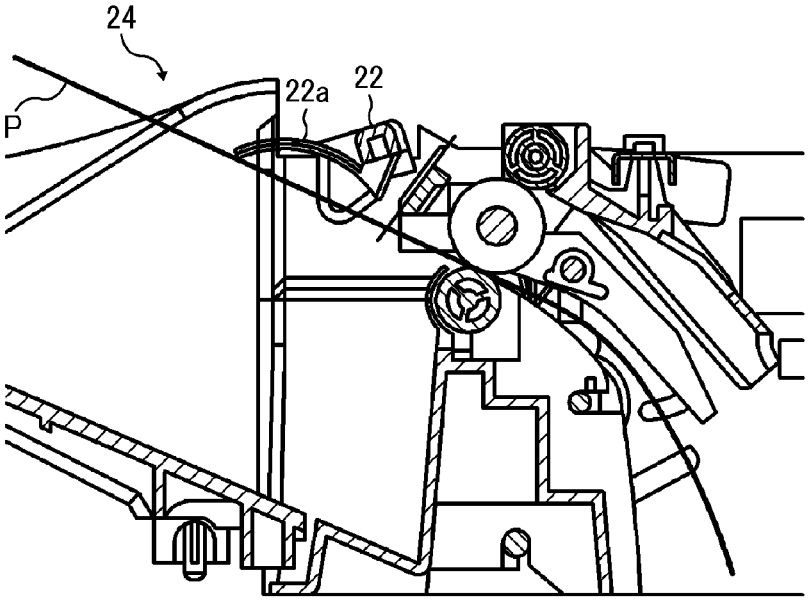
FIG. 3B is a cross sectional view illustrating the full state detection mechanism when the full state detection feeler is pushed up by a stack of recording media on the discharging tray.
Figure 3C:
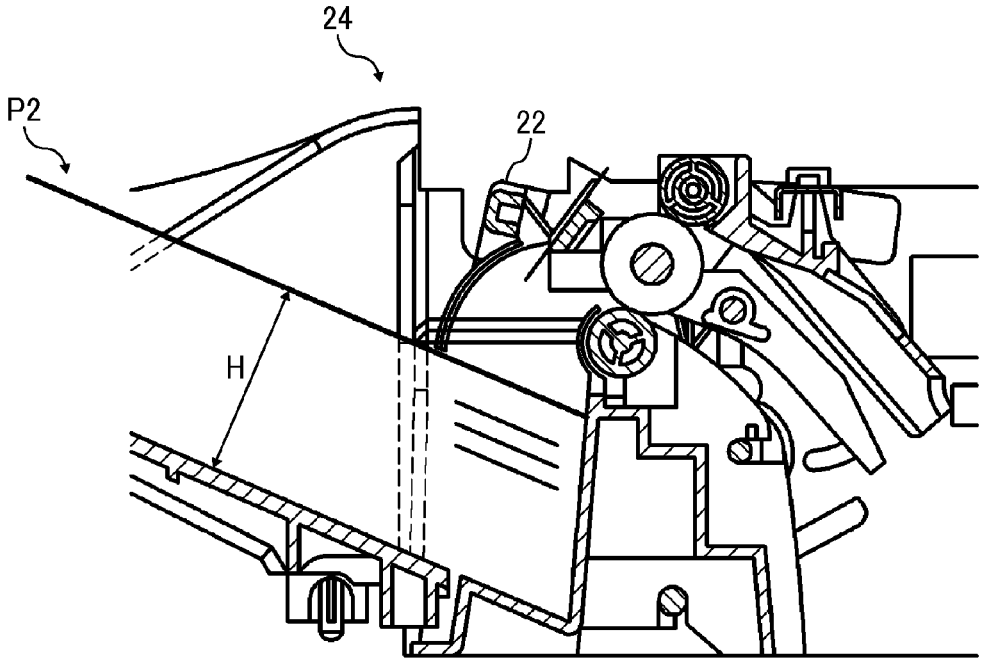
FIG. 3C is a cross sectional view illustrating the full state detection mechanism when a full state of the discharging tray is detected.

Next, a description is given of the operation principles of a full state detection mechanism of the image forming apparatus 100, with respect to FIGS. 3A through 3C.

The full state detection mechanism includes the full state detection feeler 22 and the full state detection sensor 23. The full state detection feeler 22 extends vertically in a direction perpendicular to the sheet conveying direction, in other words, with respect to the sheet surface of FIGS. 3A through 3C. Specifically, the full state detection feeler 22 is provided in the widthwise direction or the lateral direction over the recording medium P that is discharged by the sheet discharging driven roller 12 and the sheet discharging drive roller 13. The full state detection feeler 22 is pivotably supported at both ends, as illustrated in FIG. 8. The full state detection feeler 22 moves in a direction as indicated by arrow in FIG. 1 and pivots clockwise from a position illustrated in FIG. 3A to a position illustrated in FIG. 3B.

The full state detection sensor 23 detects the position of the full state detection feeler 22 that is rotatable as described above.

It is to be noted that the position of the full state detection feeler 22 indicates an angular position of the full state detection feeler 22, which is a posture in a plane perpendicular to a rotation axis of the full state detection feeler 22. For example, the full state detection sensor 23 can be an optical sensor such as a photointerrupter. Together with a rotating disk disposed at a shaft end part of the full state detection feeler 22, the optical sensor forms a rotary encoder that reads the position of a center feeler 22*a* by detecting whether an optical path through which optical light travels from a light emitting element of the full state detection sensor 23 to a light receiving element thereof is blocked or not.

FIG. 3A illustrates a state immediately before the leading edge of the recording medium P held between the sheet discharging driven roller 12 and the sheet discharging drive roller 13 hits the center feeler 22*a* of the full state detection feeler 22. Specifically, FIG. 3A shows a state before the position of the center feeler 22*a* changes, in other words, a state in which the full state detection sensor 23 is off or non-active.

FIG. 3B illustrates a state in which the recording medium P pushes up the center feeler 22*a*. Therefore, the position of the center feeler 22*a* is changed, that is, the full state detector sensor 23 is on or active.

The full state detection mechanism is designed such that an arithmetic logic unit (ALU determines, based on information from the active full state detection sensor 23, whether or not the sheet discharging tray 20 is full. When the ALU determines that the sheet discharging tray 20 is full, a signal to stop the printing operation performed in the image forming apparatus 100 is issued. However, as illustrated in FIG. 3B, pushing up the full state detection feeler 22 is not regarded as the full state of the sheet discharging tray 20. It is not until the active state of the full state detection sensor 23 continues more than a given time for at least one recording medium P to pass the full state detection feeler 22 that the sheet discharging tray 20 is detected as the full state and the signal to stop the printing operation is issued. At the same time, an alarm signal can also be issued. For example, a message to accelerate removal of the recording medium P on the sheet discharging tray 20 can be displayed on an operation panel of the image forming apparatus 100. Instead of or in addition to this function, an audio message can be sent.

FIG. 3C illustrates a state in which the sheet discharging tray 20 is full. A paper loadable height H of discharged recording media P2 stacked on the sheet discharging tray 20 is indicated in FIG. 3C.

Figure 4A:
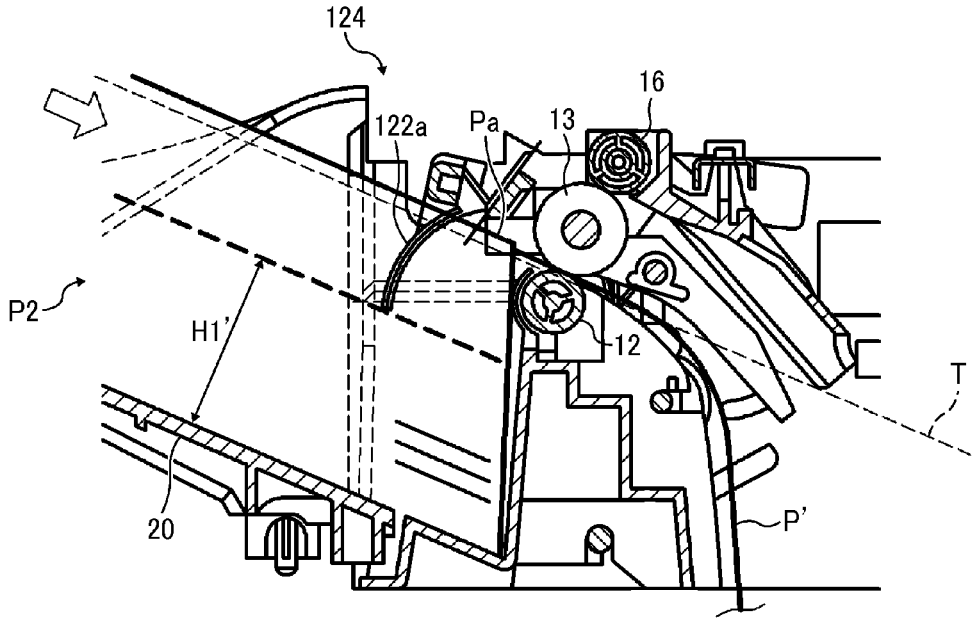
FIG. 4A is a cross sectional view illustrating a comparative full state detection mechanism.
Figure 4B:
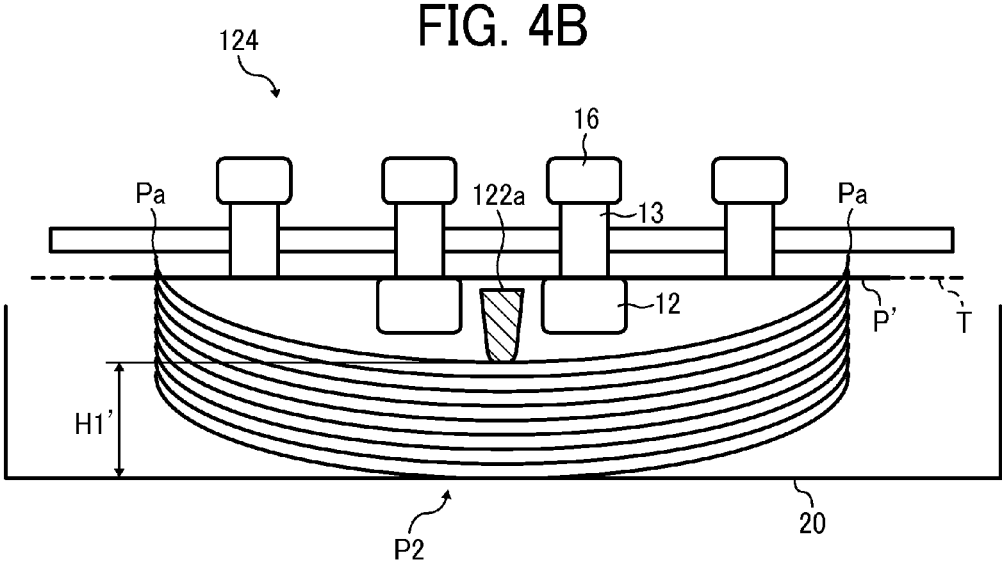
FIG. 4B is a cross sectional view illustrating the comparative full state detection mechanism of FIG. 4A, viewed from an arrow in FIG. 4A.

FIGS. 4A and 4B illustrate a comparative configuration of a sheet discharging device 124 that does not include the full state detection mechanism according to the present embodiment. In FIGS. 4A and 4B, a full state is detected when the recording medium P on the sheet discharging tray 20 has side curls (refer to FIG. 2H). Specifically, FIG. 4A illustrates the comparative configuration of the sheet discharging device 124. As illustrated in FIG. 4A, a center feeler 122*a* measures a paper loadable height H1' at the center of the recording medium P on the sheet discharging tray 20, so that the full state of the sheet discharging tray 20 is determined. In FIG. 4B, the center feeler 122*a* is illustrated while the full state detection feeler 22 is omitted. The full state detection mechanism is set to turn on the full state detection sensor 23 when the center feeler 122*a* reaches the position corresponding to the paper loadable height H1'.

Due to incompletion of image forming, a subsequent recording medium P' is further conveyed and discharged to the sheet discharging tray 20 even after the full state is detected. The subsequent recording medium P' is to be discharged in a direction of a common tangential line T of the sheet discharging driven roller 12 and the sheet discharging drive roller 13. Accordingly, the leading edge of the subsequent recording medium P' hits edges Pa of the recording medium P with side curls onto the sheet discharging tray 20 to push the recording medium P stacked on the sheet discharging tray 20. As a result, the paper stacking failure such as falling off and/or disarrangement of the discharging order of the discharged recording media P2 can occur.

Figure 5A:
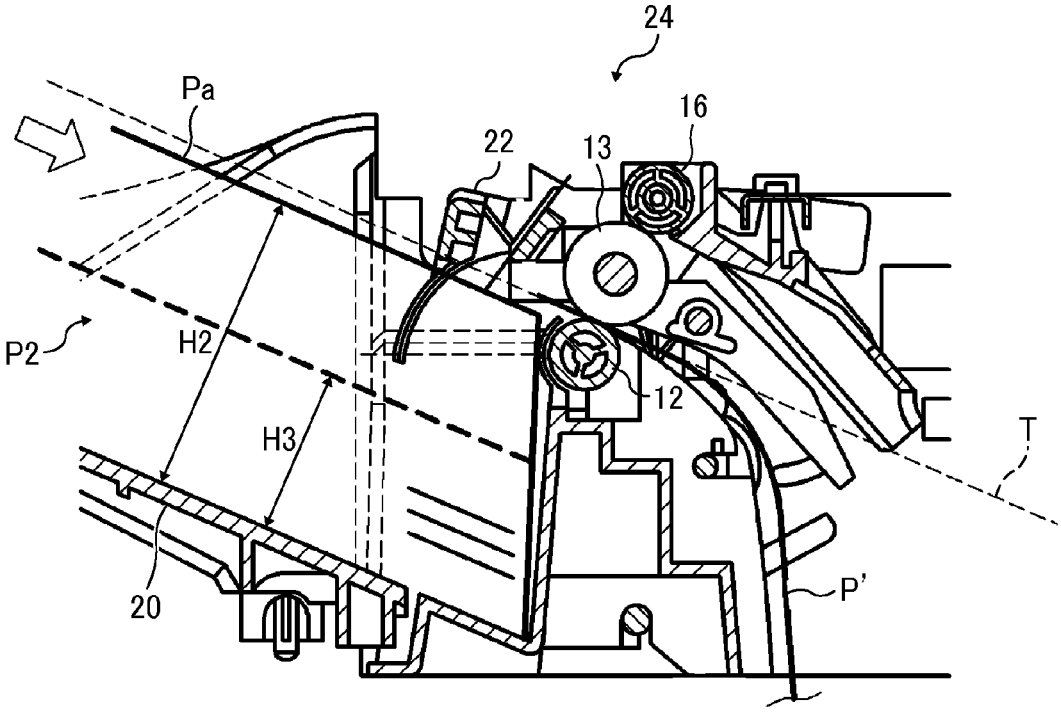
FIG. 5A is a cross sectional view illustrating a full state detection mechanism according to an embodiment.
Figure 5B:
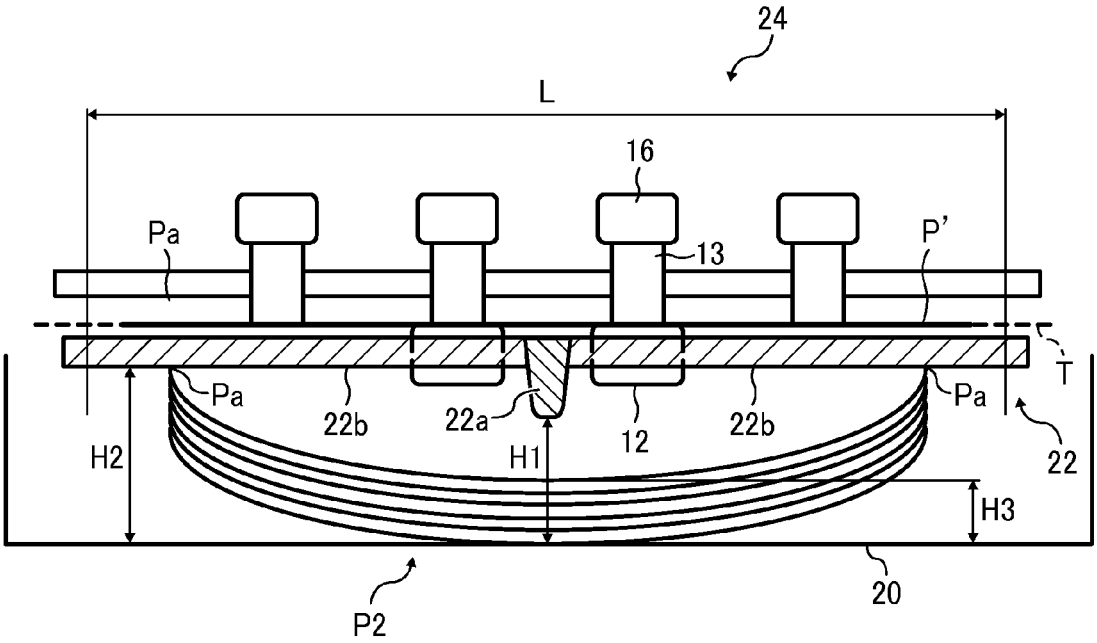
FIG. 5B is a cross sectional view illustrating the full state detection mechanism of FIG. 5A, viewed from an arrow in FIG. 5A.
Figure 5C:
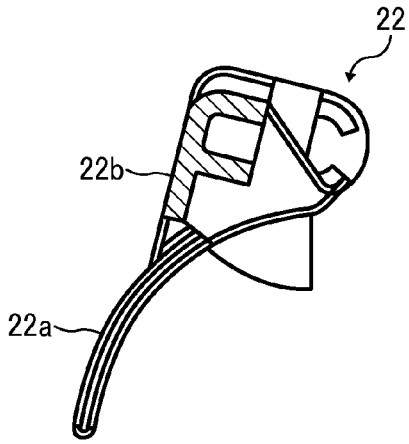
FIG. 5C is an enlarged view illustrating a full state detection feeler included in the full state detection mechanism of FIG. 5A.

Now, a description is given of a sheet discharging device 24 according to the present embodiment with reference to FIGS. 5A through 5C.

FIGS. 5A and 5B illustrate a configuration of the sheet discharging device 24 with respect to the comparative configuration of the sheet discharging device 124 of FIGS. 4A and 4B, and show the full state when the discharged recording media P2 stacked on the sheet discharging tray 20 have side curls (refer to FIG. 2H).

Figure 8A:
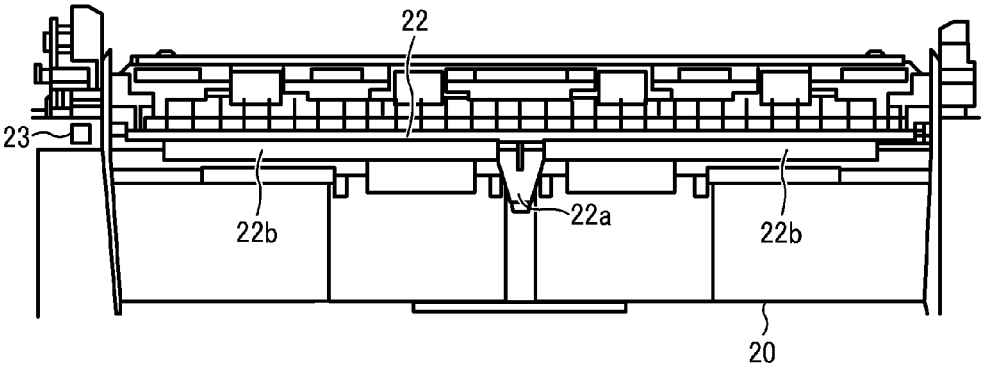
FIG. 8A is a diagram illustrating the full state detection mechanism, viewed from the discharging tray to an upstream side in the sheet conveying direction.

FIG. 5C is an enlarged view of the full state detection feeler 22 of FIG. 5A. In FIG. 5B, the center feeler 22*a* and edge feelers 22*b* are illustrated while the full state detection feeler 22 is omitted. The center feeler 22*a* is located at the center of the full state detection feeler 22, which is also illustrated in FIG. 8A, and the edge feelers 22*b* are disposed at both sides of the center feeler 22*a*.

FIGS. 5A through 5C show that the full state of the sheet discharging tray 20 detected after the edge feelers 22*b* have measured one or both edges of the discharged recording media P2 stacked on the sheet discharging tray 20 reaching the paper loadable height H2. The full state detection mechanism is previously set to turn on the full state detection sensor 23 when the edge feelers 22*b* reach a position corresponding to the paper loadable height H2. It is to be noted that the center feeler 22*a* of FIG. 5B has the same structure and function as the center feeler 122*a* of FIGS. 4A and 4B.

As illustrated in FIG. 5B, since the recording medium P has side curls (refer to FIG. 2H), the edges Pa of the recording medium P and the respective edge feelers 22*b* contact while the center feeler 22*a* does not contact the recording medium P. In this case, the full state is detected not based on the detection result obtained at the center of the recording medium P but based on the detection results obtained at the edges Pa of the recording medium P having the side curls.

Due to incompletion of image forming, the subsequent recording medium P' is further conveyed and discharged to the sheet discharging tray 20 even after the full state is detected. The subsequent recording medium P' is to be discharged in the direction of the common tangential line T of the sheet discharging driven roller 12 and the sheet discharging drive roller 13.

As illustrated in FIGS. 5A and 5B, the paper loadable height H2 of the edges Pa is located lower than the common tangential line T. In other words, respective lower edges or leading edges of the edge feelers 22*b* are located closer to an upper surface of the sheet discharging tray 20 than the common tangential line T of the sheet discharging drive roller 13 and the sheet discharging driven roller 12. This configuration can prevent the paper stocking failure caused by the subsequent recording medium P' hitting the discharged recording media P2 stacked on the sheet discharging tray 20 as illustrated in FIGS. 4A and 4B. By referring to the paper loadable heights in the full state illustrated in FIG. 5B, a paper loadable height H1 at the center part of the recording medium P and the paper loadable height H2 at the edges Pa have a relation of H1>H2. In other words, a distance between the leading edge of the center feeler 22*a* and the upper surface of the sheet discharging tray 20 is shorter or smaller than a distance between each leading edge of the edge feelers 22*b* and the upper surface of the sheet discharging tray 20. With this configuration, the paper stacking failure can be prevented in advance.

The paper loadable height H1' at the center part of the recording medium P as illustrated in FIG. 4B and a paper loadable height H3 as illustrated in FIGS. 5A and 5B have a relation of H1'>H3, which is likely that the number of stacked recording media decreases. However, in the present embodiment as illustrated in FIG. 5B, the edge feelers 22*b* press the curled edges Pa of the discharged recording media P2. Eventually, the number of stacked papers reduces by a smaller amount compared with the number of stacked recording media P2 of FIG. 4B. When the recording medium P has no curls, the center feeler 22*a* measures the height of the discharged recording media P2, and then the full state detection sensor 23 detects the full state of the sheet discharging tray 20. Therefore, the paper loadable height in the full time corresponds to the paper loadable height Hi at the center part of the recording medium P. Further, a range of the edge feelers 22*b* in an axial direction of the sheet discharging drive roller 13 extends the maximum printable paper width L of the recording medium P in the image forming apparatus 100. With this configuration, any recording medium having side curl(s) can be detected.

Figure 6A:
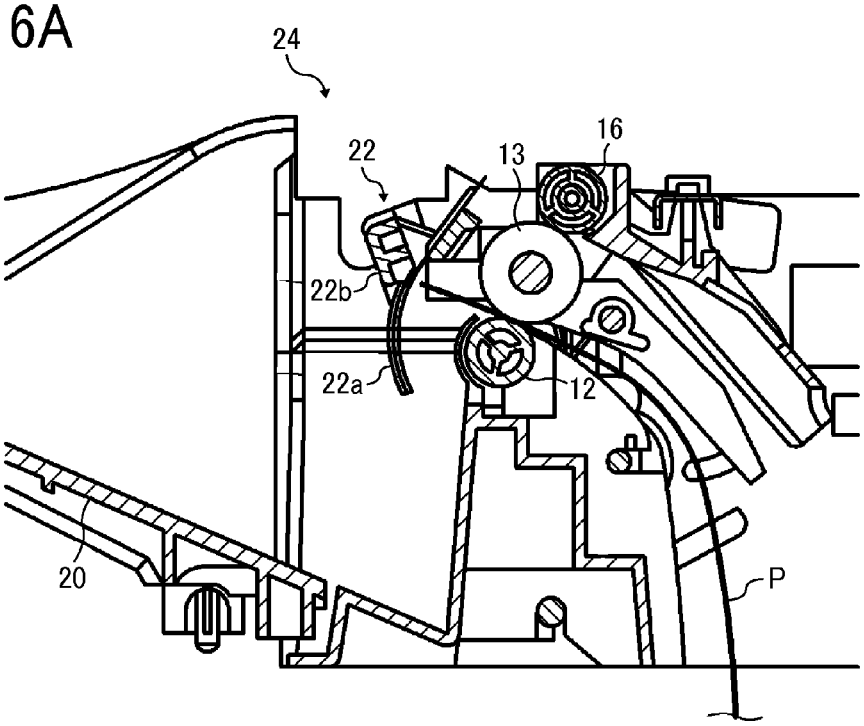
FIG. 6A is a cross sectional view illustrating movement of the full state detection feeler immediately before the full state detection feeler is pushed up.
Figure 6B:
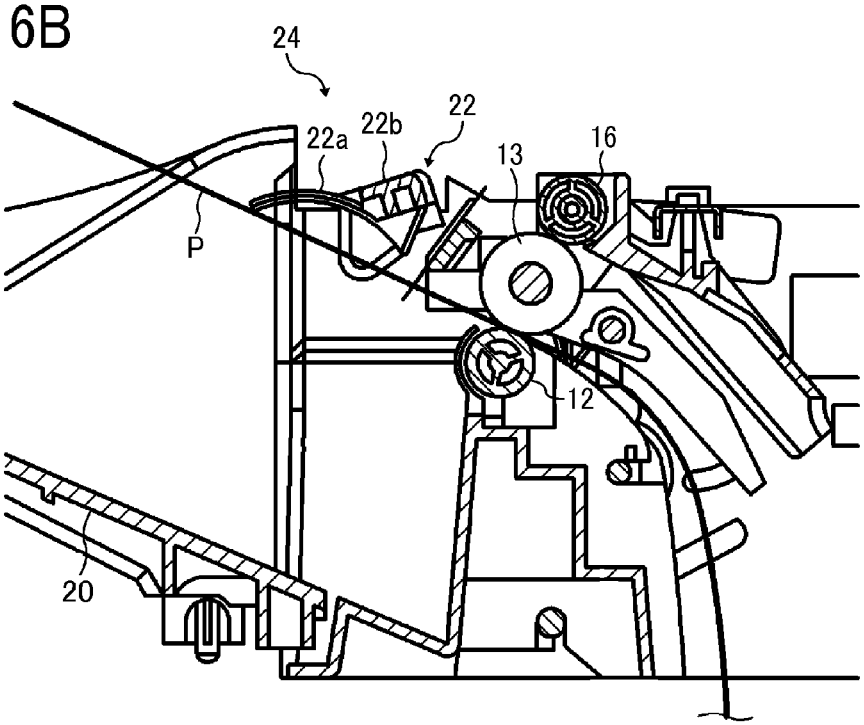
FIG. 6B is a cross sectional view illustrating movement of the full state detection feeler after the full state detection feeler has been pushed up.

Now, a description is given of operations of the full state detection feeler 22 while the recording medium P is passing thereby, with reference to FIGS. 6A and 6B.

As illustrated in FIG. 6A, the leading edge of the recording medium P conveyed by the sheet discharging drive roller 13 and the sheet discharging driven roller 12 hits the center feeler 22*a*. Consequently, as illustrated in FIG. 6B, as the discharged recording media P2 accumulates on the sheet discharging tray 20, the discharged recording media P2 push up the full state detection feeler 22. During this movement, the position of the recording medium P and the position of the edge feelers 22*b* are arranged so as to be separated away from each other without contacting. This positional arrangement of the recording medium P and the edge feelers 22*b* is made because the contact of the recording medium P with the edge feelers 22*b* can increase risk to cause damage to the leading edge of the recording medium P and/or noise generated by the recording medium P and the edge feelers 22*b* rubbing against each other.

Figure 7:
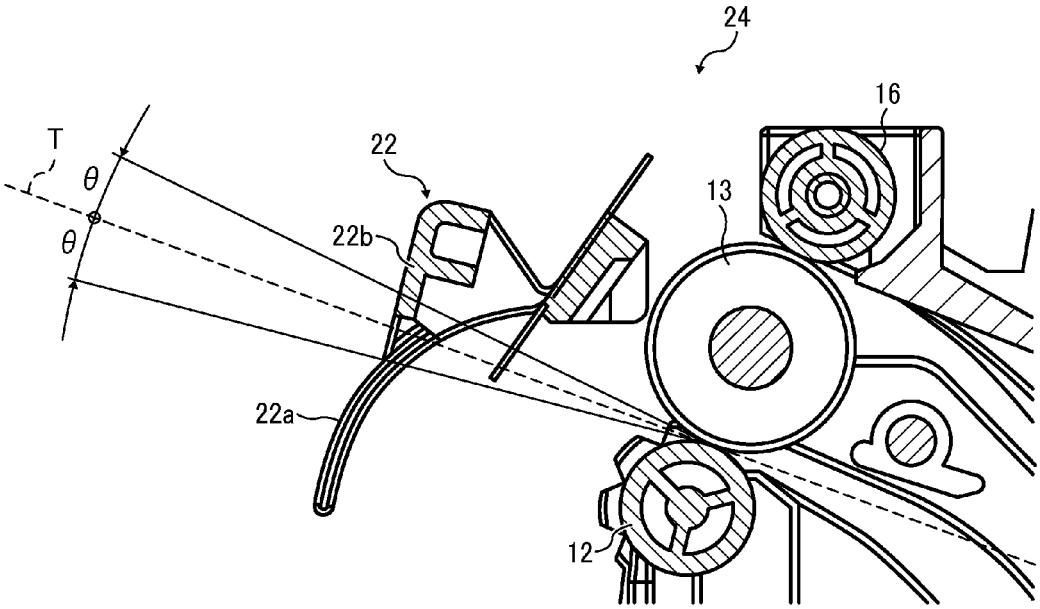
FIG. 7 is a cross sectional view illustrating the full state detection mechanism showing a position of edge feelers.

FIG. 7 illustrates the state of the full state detection feeler 22 when the edge feelers 22*b* measures the height of the recording media P2 on the sheet discharging tray 20, and the full state detection sensor 23 detects the full state of the sheet discharging tray 20.

At the contact portion of the edge feelers 22*b* with the recording medium P as illustrated in FIG. 7, when the respective leading edges of the edge feelers 22*b* are located within a range of ±θ based on the common tangent T, the full state detection sensor 23 is set to turn on according to the movement of the edge feelers 22*b*. The reason why the range is based on the common tangent T of the sheet discharging driven rollers 12 and the sheet discharging drive roller 13 is that the recording medium P is discharged in the same direction as the common tangent T.

As an example, an angle θ can be approximately 5 degrees. The action that the full state detection feeler 22 presses the discharged recording media P2 as described above with reference to FIGS. 5A and 5B has been taken into consideration to obtain the value of 5 degrees based on experimental evaluation of a range in which no paper stacking failures occur even when the subsequent recording medium P' pushes the trailing edge of the discharged recording media P2 stacked on the sheet discharging tray 20. Alternatively, a distance from the sheet discharging driven roller 12 and the sheet discharging drive roller 13 to the edge feelers 22*b*, a speed of discharging the recording medium P, rigidity of the recording medium P, and so forth can be considered to obtain an optimal angle θ of the sheet discharging device 24.

FIG. 8A is a diagram illustrating the full state detection mechanism, viewed from the discharging tray 20 to an upstream side in the sheet conveying direction. As illustrated in FIG. 8A, the center feeler 22*a* and the edge feelers 22*b* of the full state detection feeler 22 are connected serially, in other words, continuously without any slits in an axial direction of the sheet discharging driven rollers 12 and the sheet discharging drive roller 13.

Figure 8B:
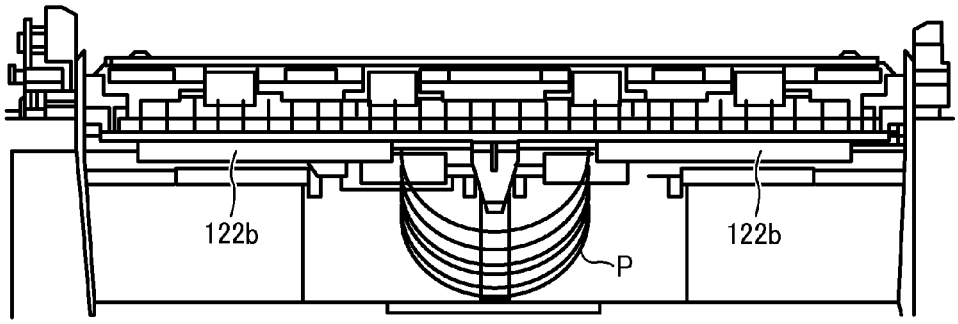
FIG. 8B is a diagram illustrating a comparative full state detection mechanism.

By contrast, FIG. 8B illustrates a comparative configuration in which the center feeler 22*a* and the edge feelers 22*b* are not connected serially and continuously. In this case, there seems to be cutouts or slits between the edge feelers 22*b*, and therefore it is likely that the edges Pa of the side-curled recording medium P having a narrow width are caught by the slits, resulting in an operation failure of the full state detection feeler 22 and/or paper jam.

The full state detection feeler 22 can be integrally provided by the center feeler 22*a* and the edge feelers 22*b* using the same material, which can contribute to a reduction in cost. For example, an integrated plastic unit can be applied to the full state detection feeler 22.

Figure 8C:
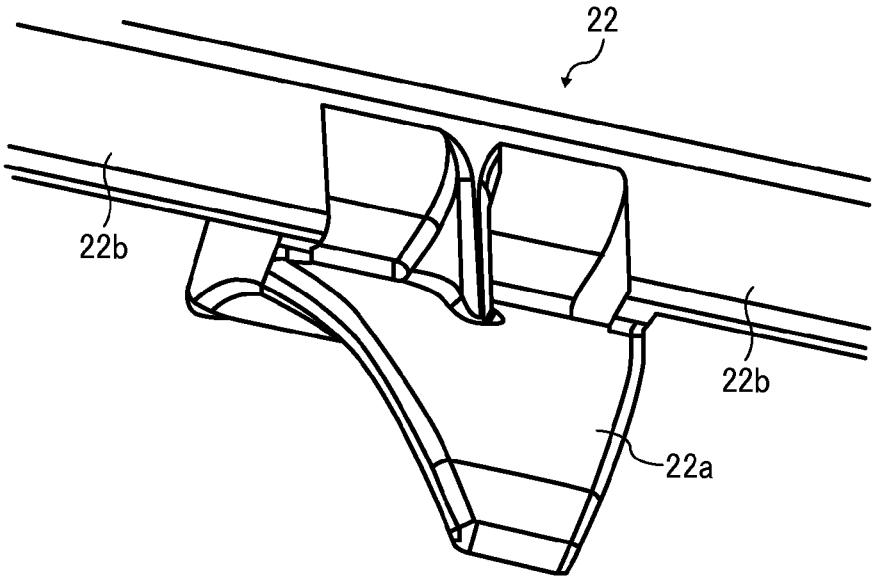
FIG. 8C is a perspective view illustrating an area adjacent to a center feeler of the full state detection feeler.

FIG. 8C illustrates the full state detection feeler 22 integrally including the edge feelers 22*b*.

Figure 8D:
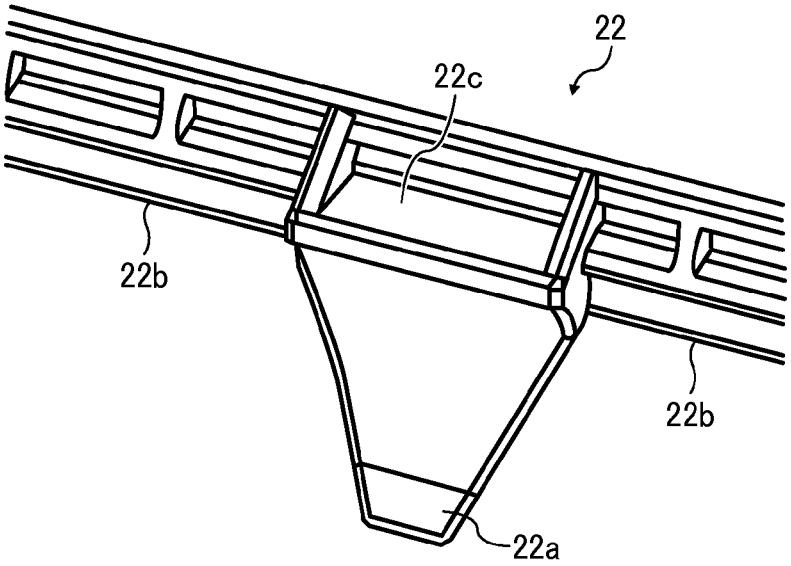
FIG. 8D is a bottom perspective view illustrating an area adjacent to a weight container of the full state detection feeler.

FIG. 8D illustrates the full state detection feeler 22 further including a weight container 22*c* on a lower surface of the center feeler 22*a*. For example, when the edge feelers 22*b* as illustrated in FIGS. 5A through 5C may need to further press recording medium P having side curls, one or more weights can be stored in the weight container 22*c*. In this case, the optional number and type of weight may be selected.

Figure 9A:
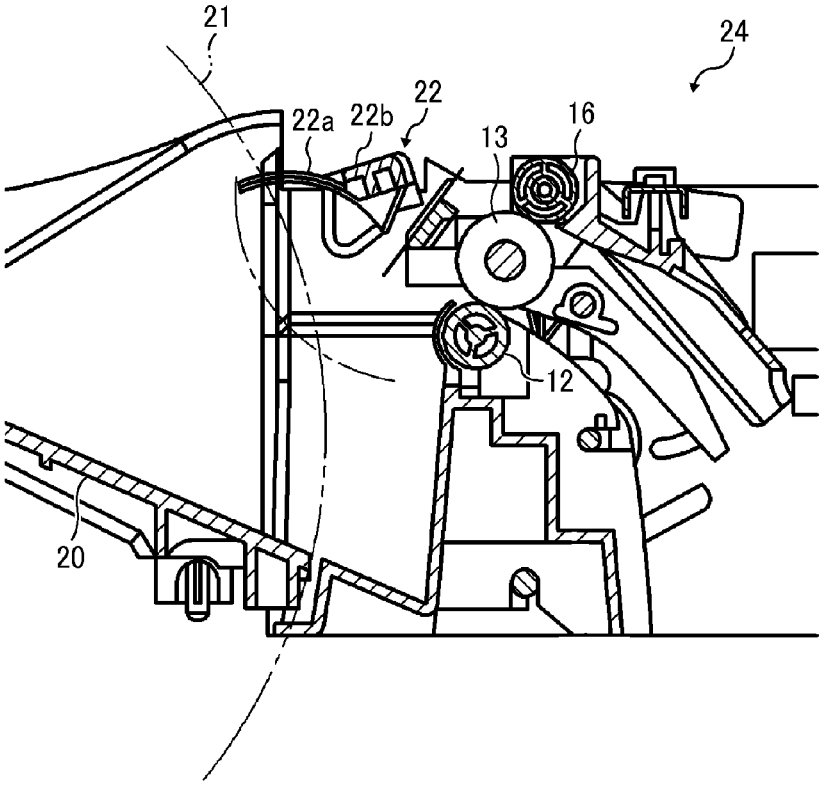
FIG. 9A is a cross sectional view illustrating a rotational locus of the discharging tray when the full state detection feeler is pushed up.
Figure 9B:
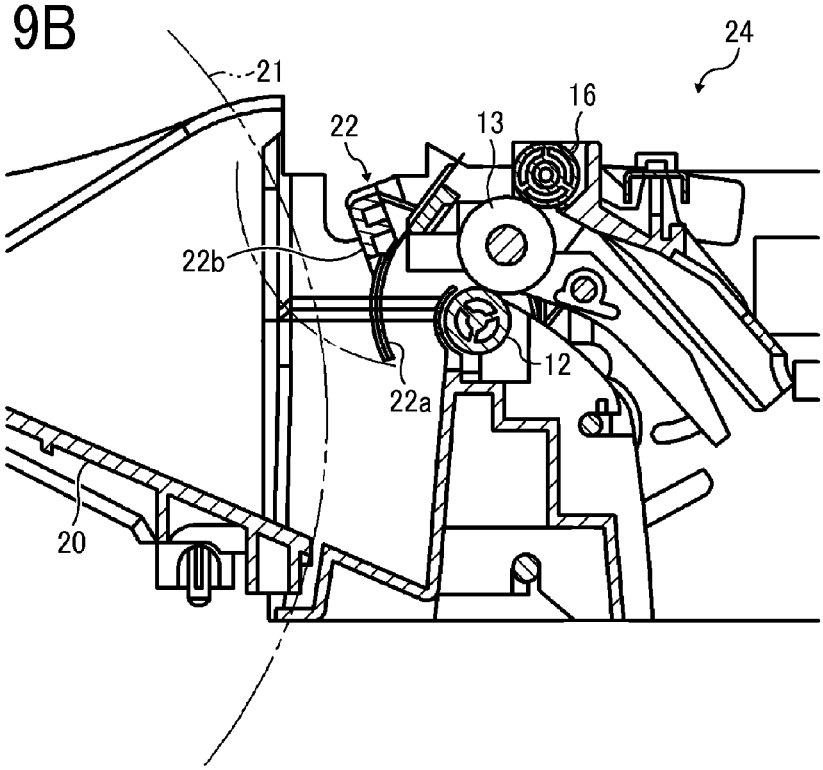
FIG. 9B is a cross sectional view illustrating a rotational locus of the discharging tray when the full state detection feeler is retreated.

FIGS. 9A and 9B illustrate a rotational locus of the sheet discharging tray 20. As illustrated in FIGS. 9A and 9B, the sheet discharging tray 20 also functions as an openable exterior of the image forming apparatus 100. For example, when a toner cartridge is replaced, the sheet discharging tray 20 can be opened. A rotational center of the sheet discharging tray 20 is illustrated in FIG. 1 with reference numeral "19". A large arc in FIGS. 9A and 9B represents the maximum rotational locus 21 of the sheet discharging tray 20. A small arc in FIGS. 9A and 9B represents the maximum rotational locus of the full state detection feeler 22. The large arc, which is the maximum rotational locus 21 of the sheet discharging tray 20, and the small arc, which is the maximum rotation locus of the full state detection feeler 22, share an intersection that is an area where the large arc and the small arc overlap as illustrated in FIG. 9A.

For example, when an operator opens the sheet discharging tray 20 while holding up the center feeler 22*a* of the full state detection feeler 22 manually, the center feeler 22*a* enters inside the maximum rotational locus 21 to interfere movement of the sheet discharging tray 20 as illustrated in FIG. 9A. When the rotation center 19 of the sheet discharging tray 20 is shifted to a further left side in FIG. 1, the full state detection feeler 22 can be retreated outside the maximum rotational locus 21. However, shifting the rotation center 19 of the sheet discharging tray 20 increases the size of a housing of the image forming apparatus 100.

To address this inconvenience, the full state detection feeler 22 according to the present embodiment is set movable without moving the rotation center 19 of the sheet discharging tray 20. As described above, the full state detection feeler 22 is pivotably supported and is pushed up by the leading edge of the recording medium P to be conveyed to the sheet discharging tray 20, as illustrated in FIG. 9A. Further, when the full state detection feeler 22 is in its natural state without application of any external force and with no recording medium P stacked on the sheet discharging tray 20, the full state detection feeler 22 retreats to the outside of the maximum rotational locus 21 of the sheet discharging tray 20 by rotating counterclockwise along with the aid of gravity as illustrated in FIG. 9B.

As described above, the present embodiment(s) can achieve the following effects.

As shown in the above-described embodiment(s), even when the recording medium P has side curls, the sheet discharging device 24 can precisely detect the full state of the sheet discharging tray 20 before paper stacking failure occurs and, at the same time, can secure a sufficient paper loadable number when the recording medium P has a small degree of curl. Accordingly, by including the above-described sheet discharging device 24, the image forming apparatus 100 that can prevent the paper stacking failure can be provided without adversely affecting a compact and low-cost configuration.

According to the action that the leading edge of the recording medium P conveyed by the sheet discharging drive roller 13 and the sheet discharging driven roller 12 contacts the center feeler 22*a*, the full state detection feeler 22 remains pushed up until the trailing edge of the recording medium P passes the full state detection feeler 22. While being contacting the center feeler 22*a*, the recording medium P is set not to contact the edge feelers 22*b*. This configuration can increase a risk to damage the leading edge of the recording medium P and/or to cause noise generated by the recording medium P and the edge feelers 22*b* rubbing against each other when the recording medium P and the edge feelers 22*b* contact.

The full state detection feeler 22 extends in an axial direction of the sheet discharging driven roller 12 and the sheet discharging drive roller 13. The center feeler 22*a* is located at the center in the axial direction of the full state detection feeler 22 and has the leading end to contact the discharged recording medium P or the discharged recording media P2 stacked on the sheet discharging tray 20. The edge feelers 22*b* are located at both sides in the axial direction of the full state detection feeler 22, interposing the center feeler 22*a* therebetween. Since the respective edges of the edge feelers 22*b* are continuously aligned in the axial direction of the full state detection feeler 22, the edge feelers 22*b* can measure the paper loadable height of the discharged recording media P2 on the sheet discharging tray 20 and the full state detection sensor 23 detects the full state of the sheet discharging tray 20 reliably regardless of the size of the recording medium P and the degree of side curls.

The respective edges of the edge feelers 22*b* contact the discharged recording media P2 stacked on the sheet discharging tray 20. According to the contact of the respective edges of the edge feelers 22*b* to the recording medium P on the sheet discharging tray 20, the position of the edges of the edge feelers 22*b* at the full state detection of the sheet discharging tray 20 is within a range of ±5 degrees with respect to the common tangent T of the sheet discharging driven roller 12 and the sheet discharging drive roller 13 in a cross-sectional view vertical along the axial direction of the sheet discharging driven roller 12 and the sheet discharging drive roller 13. By employing the configuration, even when the recording medium P has side curls, the full state of the sheet discharging tray 20 can be detected reliably. As a result, this configuration can prevent the paper stacking failure caused by the trailing edge of the recording medium P on the sheet discharging tray 20 pushing the subsequent recording medium P'.

The range of the edge feelers 22*b* in the axial direction of the sheet discharging driven roller 12 and the sheet discharging drive roller 13 is set greater than the maximum width L of the printable paper width L used in the image forming apparatus 100. By employing this configuration, any recording medium having side curls can be detected.

The center feeler 22*a* and the edge feelers 22*b* of the full state detection feeler 22 are connected continuously without any slits. With this configuration, together with the edges of the edge feelers 22*b* serially connected in the axial direction of the sheet discharging driven rollers 12 and the sheet discharging drive roller 13, any concern that the edges of the recording medium P having narrow side curls are caught in the slit to cause failure such as operational functions of the full state detection feeler 22 or paper jams can be prevented.

The full state detection feeler 22 includes the weight container 22*c*. By storing an appropriate weight(s) in the weight container 22*c* or changing the number of weights, the pressing force exerted by the full state detection feeler 22 to press the recording medium P can be adjusted.

The sheet discharging tray 20 is rotatable about its axial center. The maximum rotational locus 21 of the sheet discharging tray 20 and the maximum rotational locus of the full state detection feeler 22 share an intersection that is an area where the maximum rotational locus 21 and the maximum rotational locus overlap. With this configuration, the rotation center of the sheet discharging tray 20 is not shifted, which can contribute to a more compact image forming apparatus.

Further, when the external force is not applied, the full state detection feeler 22 pivots along with the aid of gravity and retreats to the outside of the maximum rotational locus 21 of the sheet discharging tray 20. By so doing, an interference of the sheet discharging tray 20 and the full state detection feeler 22 can be prevented.

The above-described embodiments are illustrative and do not limit the present invention. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of the present invention may be practiced otherwise than as specifically described herein.

What is claimed is:

1. A sheet discharging device comprising:

a sheet discharging tray to which a recording medium having an image formed thereon is discharged;

a sheet discharging roller pair to discharge the recording medium conveyed by a sheet conveying member disposed upstream from the sheet discharging roller pair to the sheet discharging tray;

a full state detection feeler pivotably supported to measure a height of a stack of recording media including the recording medium on the sheet discharging tray, the full state detection feeler comprising a center feeler to measure a height of a center part of a flat surface of the recording medium in a direction perpendicular to a sheet conveying direction, and an edge feeler to measure a height of an edge part of the flat surface of the recording medium in the direction perpendicular to the sheet conveying direction; and a full state detection sensor to detect a position of the full state detection feeler to determine whether the sheet discharging tray is in a full state, wherein a distance between a leading edge of the center feeler and an upper surface of the sheet discharging tray is smaller than a distance between a leading edge of the edge feeler and the upper surface of the sheet discharging tray, wherein the leading edge of the edge feeler is located closer to the upper surface of the sheet discharging tray than a common tangential line of the sheet discharging roller pair.

2. The sheet discharging device according to claim 1, wherein, due to a contact of the leading edge of the recording medium conveyed by the sheet discharging roller pair with the center feeler, the full state detection feeler is pushed up until a trailing edge of the recording medium passes through the center feeler, wherein, while the recording medium is in contact with the center feeler, the recording medium is separated away from the edge feeler.

3. The sheet discharging device according to claim 1, wherein the center feeler is located at a center of the axial direction of the full state detector feeler, wherein the leading edge of the center feeler contacts the recording medium on the sheet discharging tray, wherein the edge feeler includes multiple edge feelers located at both ends of the center feeler, wherein the respective leading edges of the edge feelers continuously disposed in the axial direction of the sheet discharging pair contact the recording medium on the sheet discharging tray.

4. The sheet discharging device according to claim 3, wherein the full state detection sensor detects the full state of the sheet discharging tray when the leading edges of the edge feelers contact the recording medium on the sheet discharging tray, wherein the position of the leading edges of the edge feelers at the full state detection of the sheet discharging tray is located within a range of ±5 degrees with respect to a common tangent line of the sheet discharging roller pair in a cross-sectional view perpendicular to the axial direction of the sheet discharging roller pair.

5. The sheet discharging device according to claim 1, wherein a range of the edge feelers in the axial direction of the sheet discharging roller pair is set greater than a maximum width of a printable paper width in an image forming apparatus.

6. The sheet discharging device according to claim 1, wherein the center feeler and the edge feelers of the full state detection feeler are connected continuously without any slits.

7. The sheet discharging device according to claim 1, wherein the full state detection feeler includes a weight container.

8. The sheet discharging device according to claim 1, wherein the sheet discharging tray rotates about an axial center thereof, wherein a maximum rotational locus of the sheet discharging tray and a maximum rotational locus of the full state detection feeler share an area where the maximum rotational focuses overlap.

9. The sheet discharging device according to claim 8, wherein, when the full state detection feeler is not in contact with the recording medium, the full state detection feeler rotates along with an aid of gravity and retreats to a position outside a maximum rotational locus of the sheet discharging tray.

10. An image forming apparatus comprising:

an image forming unit to form an image on a surface of an image carrier; and the sheet discharging device according to claim 1.

* * * * *